US008026034B2

(12) United States Patent
Regan et al.

(10) Patent No.: US 8,026,034 B2
(45) Date of Patent: Sep. 27, 2011

(54) ENHANCED FUSING FOR ELECTROPHOTOGRAPHIC TONERS

(75) Inventors: Michael T. Regan, Cambridge, MA (US); Mridula Nair, Penfield, NY (US); David D. Putnam, Fairport, NY (US); Joseph S. Sedita, Albion, NY (US); Cumar Sreekumar, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 457 days.

(21) Appl. No.: 12/342,435

(22) Filed: Dec. 23, 2008

(65) Prior Publication Data

US 2010/0159384 A1 Jun. 24, 2010

(51) Int. Cl.
*G03G 15/20* (2006.01)

(52) U.S. Cl. ..... 430/124.21; 399/338

(58) Field of Classification Search ..... 430/124.21; 399/338

See application file for complete search history.

(56) References Cited

U.S. PATENT DOCUMENTS

2007/0140741 A1* 6/2007 Slattery et al. ..... 399/253
2007/0140742 A1* 6/2007 Slattery et al. ..... 399/253

FOREIGN PATENT DOCUMENTS

JP 63261289 * 10/1988

OTHER PUBLICATIONS

Abstract of JP 63261289 Oct. 1988.*

* cited by examiner

*Primary Examiner* — Hoa V Le
(74) *Attorney, Agent, or Firm* — Andrew J. Anderson

(57) ABSTRACT

An electrophotographic method for producing fused toner images on a receiver medium comprising the steps of: forming an electrostatic image pattern on an image forming member; developing the image pattern on the image forming member with fusible toner particles thereby forming a toner image thereon; transferring the toner image to the receiver medium; and heating the toner image to form a fused toner image on the receiver medium, wherein an amount of a plasticizer is added to the toner particles of the toner image after formation of the toner image on the image forming member and prior to or concurrent with fusing of the transferred toner image on the receiver medium, further wherein the amount of plasticizer added is effective in lowering the Tg of the toner below that of the toner under prevailing ambient conditions in the absence of the added plasticizer. The current invention overcomes the limitations of the prior art because the plasticizer is added immediately before fusing, thus avoiding toner clumping upon storage, as well as eliminating the high cost associated with a custom manufactured receiver that already contains plasticizer.

20 Claims, 5 Drawing Sheets

POROUS TONER FUSED AT 185 C
HUMIDIFIED

POROUS TONER FUSED AT 185 C
NON-HUMIDIFIED

ENHANCED FUSING FOR ELECTROPHOTOGRAPHIC TONERS

FIELD OF THE INVENTION

This invention relates to a novel method to form electrophotographic images, more particularly to a method of plasticizing a toner image after image formation and before fusing.

BACKGROUND OF THE INVENTION

Generally in electrophotographic reproduction the original to be copied is rendered in the form of a latent electrostatic image on a photosensitive member. This latent image is made visible by the application of triboelectrically charged toner.

Conventional electrophotographic toner powders are made up of a binder polymer and other ingredients, such as pigment and a charge control agent, that are melt blended on a heated roll or in an extruder. The resulting solidified blend is then ground or pulverized to form a powder.

The toner thusly forming the image is transferred to a receiver, such as paper or transparent film, and fixed or fused to the receiver. The fusing of toner to receiver can be effected by applying heat, preferably at a temperature of about 90° C. to 200° C.; pressure may be employed in conjunction with the heat.

Application of the requisite heat causes problems such as low printer productivity, receiver damage, excessive energy use, long heat up times for equipment to reach fusing temperature and the like.

The proper fusing temperature is operationally defined as the minimum temperature range above the Tg at which the fused toned image develops sufficient adhesion to the final image receptor to resist removal by abrasion or cracking (see, e.g., L. DeMejo, et al., SPIE Hard Copy and Printing Materials, Media, and Process, 1253, 85 (1990); and T. Satoh, et al., Journal of Imaging Science, 35 (6), 373 (1991)). Minimizing the proper fusing temperature is desirable because the time required to heat the fuser assembly to the proper temperature will be reduced, the power consumed to maintain the fuser assembly at the proper temperature will be reduced, and the thermal demands on the fuser roll materials will be reduced if the minimum fusing temperature can be reduced. The art continually searches for improved dry toner compositions that produce high quality, durable images at low fusing temperatures on the final image receptor.

It has been known for a long time that various additives can be used to modify toner polymer properties and improve fusing. U.S. Pat. Nos. 3,794,594 and 3,980,575, for example, describe the addition of plasticizers. The use of plasticizer in electrophotographic toner compositions beneficially allows formulation of toner particles using materials that otherwise would not be suitable for use in these compositions, because the fusing temperature would otherwise be unacceptably high.

However, there is a problem with the use of plasticizers. When the Tg of the toner is too low, problems such as clumping and flaking in storage, are manifested. Thusly, British Patent GB 2 113 413 describes addition of a plasticizer which has limited solubility in the toner polymer at normal operating, handling and storage temperature. Crystalline aggregates are formed which do not affect Tg. At elevated fusing temperatures the plasticizer melts and induces reduced viscosity of the toner polymer.

U.S. Pat. Nos. 3,488,189 and 3,493,412 describe addition of a solid crystalline plasticizer to the receiving sheet rather than incorporating the plasticizer in the toner particle. Thus, the toners will not be tacky and clump in storage.

Japanese Kokai 2005-208350 describes a polyester resin and a plasticizer which are mixed at 130-210 degrees C. to give toners which are excellent in fixability and endurance.

Russian Patent SU 1769183 describes a toner comprising a styrene-butyl acrylate copolymer, a dye, and a plasticizer which is dioctyl phthalate.

SUMMARY OF THE INVENTION

An object of the present invention is to provide a method to improve toner fusing.

A further object of the present invention is to provide a method to lower toner Tg for fusing while preventing toner clumping prior to fusing.

A still further object of the present invention is to enable faster printing speeds.

A still further object of the present invention is to enable faster warm-up times from the sleep mode.

A still further object of the present invention is to enable lower power consumption.

A still further object of the present invention is to avoid thermal distortion of sensitive substrates.

A still further object of this invention is to reduce fuser operating temperature and thus extend fuser roller life.

The present invention is an electrophotographic method for producing fused toner images on a receiver medium comprising the steps of: forming an electrostatic image pattern on an image forming member; developing the image pattern on the image forming member with fusible toner particles thereby forming a toner image thereon; transferring the toner image to the receiver medium; and heating the toner image to form a fused toner image on the receiver medium, wherein an amount of a plasticizer is added to the toner particles of the toner image after formation of the toner image on the image forming member and prior to or concurrent with fusing of the transferred toner image on the receiver medium, further wherein the amount of plasticizer added is effective in lowering the Tg of the toner below that of the toner under prevailing ambient conditions in the absence of the added plasticizer.

The current invention overcomes the limitations of the prior art because the plasticizer is added immediately before fusing, thus avoiding toner clumping upon storage, as well as eliminating the high cost associated with a custom manufactured receiver that already contains plasticizer.

DETAILED DESCRIPTION OF THE INVENTION

The present invention concerns image forming and fusing methods for forming toner images, such as by electrophotography or other electrostatographic methods.

Figure 1:
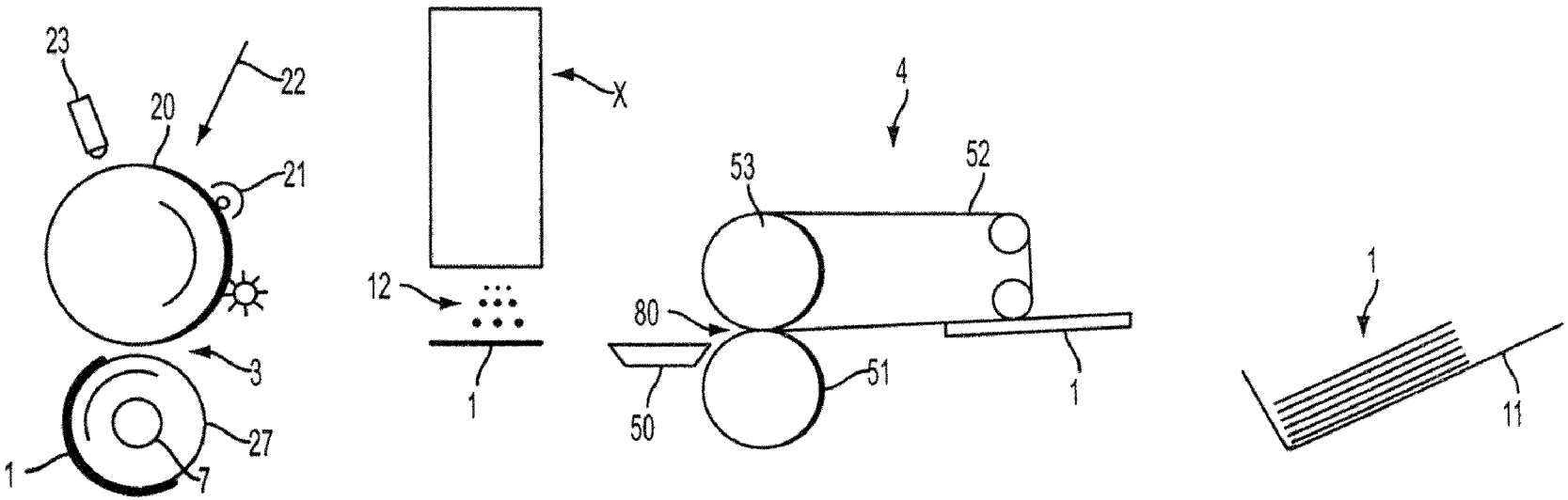
FIG. 1 is a side schematic representation, and sectional view, of an image forming apparatus and method, including a plasticizer application apparatus used in conjunction with a belt fuser, in accordance with an embodiment of the present invention.

Referring to FIG. 1 which depicts generally an electrostatographic device, a series of electrostatic images are formed on an image member 20. More specifically, image member 20 is uniformly charged by a charging device 21 and thereafter exposed by an exposing device, such as for example, a laser (or LED array) 22 to create the series of electrostatic images. Each of the images is toned by a toning station 23 to create a series of toner images corresponding to the electrostatic images.

The receiver 1 is attached to the periphery of an image transfer member 27 and rotated through a transfer nip 3 to transfer the electrostatic images on the image member 20 to the receiver 1 to form an image thereon. Transfer can be accomplished by heating transfer member 27 internally with a heat source, for example, a quartz lamp 7 to soften the toner being transferred. Transfer can also be assisted with an electrostatic field.

The receiver 1 bearing the toner image thereon is separated from image transfer member 27 and then fed to further apparatus to lower Tg by addition of plasticizer. Any method can be used to apply the plasticizer. For instance, the image containing receiver medium can be passed through a bath or a spray mist of plasticizer. Or, the medium can be passed through a chamber containing air maintained at a high concentration of plasticizer vapor. Preferred is spraying a mist of plasticizer in a controlled fashion. As shown in FIG. 1, the toner image is treated by use of a plasticizer applicator X. Where a spray type applicator is employed as depicted in FIG. 1, e.g., plasticizer applicator X may comprise a reservoir holding the plasticizer which is fed to a nozzle which deposits a spray or mist 12 of plasticizer onto the toner image transferred to receiver member 1.

After the plasticizer is added the image may be fused by any known technique. The receiver 1 bearing the plasticized toner image thereon is separated from plasticizer applicator apparatus X and then fed to further apparatus to be fused to the receiver and otherwise finished as desired. For example, as shown in FIG. 1, the toner image is fused to the receiver by use of a belt-type fusing system 4, which receiver bearing the fused toner image is finally deposited in an output tray 11.

Plasticizers useful in the method of this invention are not limited and any material which lowers the Tg of the toner may be used. Examples of plasticizers include water; straight, branched or cyclo-alkyl compounds; straight, branched or cyclo-alkyl phthalate compounds; straight, branched or cyclo-alkyl esters; straight, branched or cyclo-alkyl phosphate compounds; isoparaffinic solvents; and mixtures thereof. Preferred plasticizers are water, methyl oleate, heptane, dibutyl phthalate, tributyl phosphate, $C_{10}$-$C_{11}$ isoparaffins, and low boiling synthetic hydrocarbon blends.

Plasticizer which remains in the final image can cause problems such as image blocking whereby images stacked in a pile or placed face to face can stick together. Therefore, it is advantageous if the plasticizer is volatile enough to be removed during the fusing process. In addition, it can be readily understood that non-toxic and environmentally friendly plasticizers are preferred. In this regard, particularly preferred as a plasticizer is water.

The plasticizer is applied to the toner image on the receiver medium. In some cases, toner may absorb plasticizer (such as water) from the ambient environment. The amount of plasticizer applied per this invention is effective to reduce the Tg, as compared to the electrographic toner composition under prevailing ambient conditions in the absence of the added plasticizer. In a preferred embodiments of the invention, the Tg of the plasticized toner is at least 1° C. less than the unplasticized toner, more preferably at least 2° C. less than the unplasticized toner.

Where a belt-type fuser member is employed as shown in FIG. 1, fusing apparatus 4 can include an optional preheating device 50 which raises or maintains the temperature of the receiver, a pair of opposed pressure rollers 51 and 53, and an endless fusing belt 52 trained about a series of rollers which includes roller 53. Rollers 51 and 53 are urged together with sufficient force to create substantial pressure in a fusing nip 80 formed between fusing belt 52 and pressure roller 51. At least one of rollers 51 and 53 is generally heated to raise or maintain the temperature of the toner above its glass transition temperature, using for example, quartz lamps (not shown) positioned internally within rollers 51 and/or 53. Alternatively, the rollers can be externally heated by use of external heater rollers, lamps, or other heat sources. The heat and pressure combination within fusing nip 80 causes the toner to soften and bond to the receiver. The receiver bearing the fused toner image thereon continues out of the fusing nip 80 while maintaining contact with belt 52 until the receiver has cooled to a desired temperature, such as below the glass transition temperature of the toner. At this point, receiver 1 is separated from belt 52. Cooling of the toner image before separation can allow for separation without the use of offset-preventing liquids which could degrade the fused toner image.

An example of a fusing apparatus which employs such a belt fuser member is described in U.S. Pat. No. 5,778,295, the teachings of which are incorporated herein by reference in their entirety.

Figure 2:
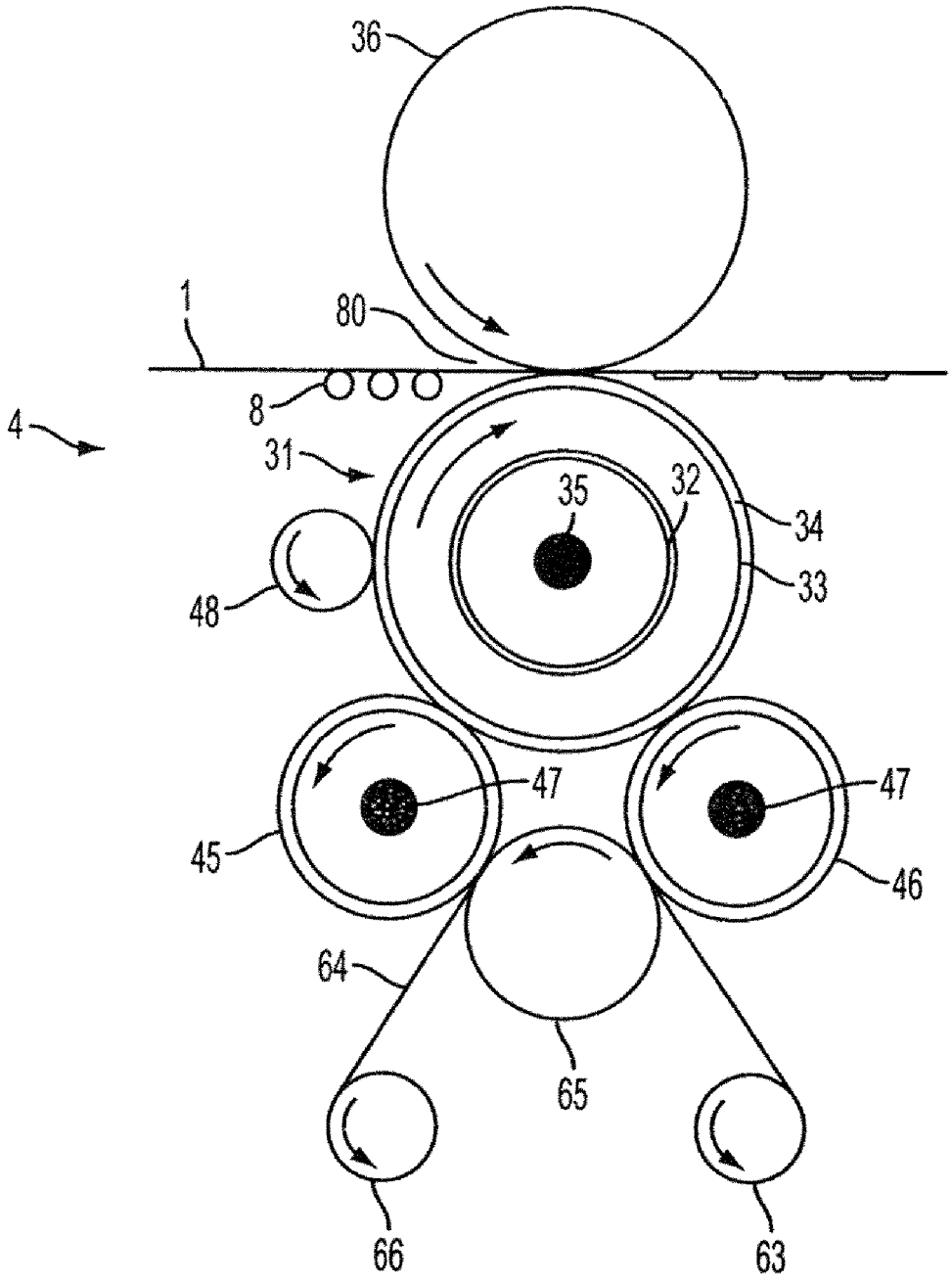
FIG. 2 is a side schematic representation, and sectional view, of an image forming apparatus and method, including a plasticizer application apparatus used in conjunction with an externally heated roller fuser, in accordance with an embodiment of the present invention.

In an other embodiment of the invention, fusing apparatus employing a heated fuser roller with external heater members as shown in FIG. 2 may be used in place of the belt-type fuser depicted in FIG. 1. In FIG. 2, a fuser member 31 in roller form comprises, in sequential order, a fuser base, i.e., core 32, in the form of a hollow cylindrical roller, as well as a base cushion layer 33 and a fusing surface layer 34. Internal heat source 35, an optional feature, can be disposed in the hollow portion of fuser base 32.

External heater members 45 and 46 are in the form of hollow cylindrical rollers; with their rotational directions, and the rotational directions of all the other rotating elements, being shown by the respective arrows depicted on FIG. 2. Alternatively, the rotational directions as depicted can be reversed. External heater members 45 and 46 are heated by respective heating lamps 47. These two external heater members are shown spaced apart by a distance less than the diameter of fuser member 31, which is in contact with both. External heater members 45 and 46 transfer heat to fuser member 31 by contact with fusing surface layer 34.

Rotating wick oiler 48 may be employed to apply a release agent to fusing surface layer 34.

Support member 36, in the form of a backup or pressure roller, cooperates with fuser member 31 to form fusing nip 80. A receiver 1, carrying unfused toner images 8 thereon, passes through fusing nip 80 after application of plasticizer by plasticizer applicator X (such as shown in FIG. 1), so that plasticized toner images 8 are contacted by fusing surface layer 34. Support member 36 and fuser member 31 act together to apply pressure to receiver 1 and toner images 8, and fuser member 31 also concurrently provides heat, with the heat and pressure both serving to fuse toner 8 to receiver 1.

A cleaning assembly is also advantageously employed to clean toner particles that may adhere to the external heater members during operation of the fuser apparatus. In such an assembly as shown in FIG. 2, a dispensing roller 63 incrementally feeds cleaning web 64 over advance roller 65, to be rolled up onto collecting roller 66. In passing along roller 65, web 64 contacts and cleans contact heating members 45 and 46. Cleaning web 64 can be a polyamide material or its equivalent, such as NOMEX® polyamide commercially available from BMP of America, Medina, N.Y. However, any other suitable cleaning material may be employed. In place of the foregoing cleaning assembly, any other means or apparatus appropriate for cleaning the external heater members may be employed. Alternatively, the external heater members can be provided with a nonstick coating, such as a fluoropolymer material like TEFLON® fluoropolymer commercially available from DuPont of Wilmington, Del., and it can also include a heat conducting filler. Where the external heater members have a nonstick coating, a cleaning assembly or its equivalent for cleaning these members can be omitted.

The fuser member 31 and, optionally, support member 36 may in general be coated with one or more layers of elastomeric materials, such as silicone elastomers, fluoroelastomers, and so-called interpenetrating networks of silicone and fluoroelastomers. Such materials are generally disclosed, for example, in U.S. Pat. Nos. 5,141,788; 5,166,031; 5,281,506; 5,366,772; 5,370,931; 5,480,938; 5,846,643; 5,918,098; 6,037,092; 6,099,673; and 6,159,588, the teachings of which are incorporated herein by reference. Such elastomeric materials may be modified such that they have durometer hardness, filler content, and other aspects as more fully described in U.S. Pat. No. 7,014,976, the disclosure of which is incorporated by reference herein. Additionally or alternatively, fuser member 31 and support member 36 may be coated with an external layer comprising fluorothermoplastic resins such as described in US20070298217 A1, US20070298251 A1, US20070298252 A1, and US20070296122 A1, the disclosures of which are incorporated by reference herein. Such external layers are particularly advantageous when employing oil-less fusing (i.e., where no release agent is applied by wick oiler 48).

While FIGS. 1 and 2 depict contact fusing methods, non-contact fusing methods may alternatively be used. In the non-contact fusing process there is no direct contact of the toner image with a solid heating body. Such processes include: (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp. Flash fusing consists of short bursts of radiant near infrared (NIR) energy. Infrared fusing is a slower process than flash fusing, and applies mid and far infrared energy. Ultraviolet (UV) fusing applies mostly UV energy, but there is residual infrared energy that assists in the heating process. Hot air fusing may also be employed, which uses hot air convection to transfer heat to the toner and substrate, for example with a hot air bearing as described in U.S. Pat. No. 3,962,799. Microwave fusing applies a high-energy electromagnetic field at 2.45 Ghz that excites dipolar molecules causing molecular vibration (friction) heating. All these technologies can be used to melt the toner onto the substrate to fix the toner to the substrate and to achieve some level of surface finish.

While FIG. 1 depicts a process wherein an image is formed on the imaging member, transferred directly from the imaging member to the receiver, followed by separate plasticization and fusing steps, other embodiments of the invention are also contemplated, wherein the plastization step can be incorporated in a wide variety of electrophotographic processes. For example, the image can be first transferred to an intermediate transfer member such as a belt or cylinder and subsequently transferred to a receiver, followed by plasticization and subsequent fusing. Alternatively, the image may be plasticized while on an intermediate transfer member, followed by a one step trans-fusing process in which the image is simultaneously transferred and fused to the receiver. In the case of non-contact fusing, the plasticization and fusing steps can be combined in one process such as use of hot air bearing fusing employing moist hot air.

The quality of fusing can be determined by measuring the gloss of the fused image. Higher image gloss indicates a smoother surface and therefore better melting and fusing of the toner. A typical gloss measurement method utilizes a single reflectivity measurement, as of a type that measures the amount of light from a standard source that is specularly reflected in a defined path. A suitable device for this purpose is a Glossgard II 20° glossmeter (available commercially from Pacific Scientific, Inc., Silver Springs, Md.) which produces a reading on a standardized scale, of a specularly reflected ray of light having angles of incidence and reflection of 10° to the normal. The standard scale of such meter has a range from 0 to 100, the instrument being normally calibrated or adjusted so that the upper limit corresponds to a surface that has substantially less than the complete specular reflection of a true mirror. Reflectivity readings are indicated as gloss numbers. Other gloss meters are readily available such as the hand-held gloss meter manufactured by BYK-Gardner, Inc.

Toners can be prepared by a variety of processes. The most common of which is melt compounding of the formulation components (polymer, charge agent, colorant, and wax) followed by pulverization and classification. These steps are usually followed by a surface treatment step in which small inorganic particles are attached to the toner surface to improve flow and tribo charging. Chemical methods have also been developed to prepare toners. An example would be the emulsion agglomeration process. For chemically prepared toners made by the emulsion agglomeration technology, aqueous dispersions of wax, latex, pigment and charge control agent are mixed in a reactor and aggregated to form toner-sized particles. Aqueous dispersions of wax can be prepared by several methods. U.S. Pat. Nos. 6,849,371 and 6,210,853 disclose the preparation of wax dispersions by using a sulfonated polyester as a dispersant, which is also the toner binder, raising the aqueous dispersion temperature to above the melting point of the wax, using a high pressure reactor and then emulsifying the wax. U.S. Pat. No. 6,808,851 discloses a similar method with an anionic surfactant as the stabilizer. U.S. Patent Application No. 20040044108 A1 describes the details of preparing the wax dispersions. It is substantially more difficult to carry out the emulsion aggregation process and incorporate the wax, than by using a solvent to dissolve and disperse the toner components.

In addition, chemically prepared toners can be prepared by a limited coalescence process. Limited coalescence techniques of this type have been described in numerous US Patents pertaining to the preparation of electrostatic toner particles because such techniques typically result in the formation of polymer particles having a substantially uniform size distribution. Representative limited coalescence processes employed in toner preparation are described in U.S. Pat. Nos. 4,833,060, 4,965,131, 6,544,705, 682,866; and 6,800,412; and U.S. Patent Application No. 20040161687 A1, incorporated herein by reference for all that they contain.

Limited coalescence techniques are particularly advantageous in that they can produce smaller toner particles with narrower size distributions than grinding and pulverizing. These smaller toner particle sizes result in improved image quality.

In a preferred embodiment toner is prepared by dissolving/dispersing the binder, optionally one or more pigments, one or more charge control agents in one or more solvents. A wax dispersion may be added to this mixture and mixed well. The order of adding the dispersion is not important. An aqueous phase containing a stabilizer is also prepared. The preferred stabilizer is particulate and optionally, a promoter is used to drive the particulate stabilizer to the interface between the water layer and the polymer solvent droplets formed by homogenizing the system. Suitable colloidal stabilizers known in the art of forming polymeric particles by the limited coalescence technique can be employed such as, for example, inorganic materials such as, metal salt or hydroxides or oxides or clays, organic materials such as starches, sulfonated crosslinked organic homopolymers and resinous polymers as described, for example, in U.S. Pat. No. 2,932,629; silica as described in U.S. Pat. No. 4,833,060; and copolymers such as copoly(styrene-2-hydroxyethyl methacrylate-methacrylic acid-ethylene glycol dimethacrylate) as described in U.S. Pat. No. 4,965,131, all of which are incorporated herein by reference. Silica is the preferred suspension stabilizing agent for use in preparing toners by limited coalescence processes. The silica stabilizer generally should have dimensions such that they are from about 0.001 μm to about 1 μm preferably from about 5 to 150 nanometers and most preferably from about 5-75 nanometers. The size and concentration of these particles control and predetermine the size of the final toner particle. Examples of colloidal silica are those sold under the brand names of Ludox, Nalcoag and Snowtex among others. Colloidal silicas are naturally charged negatively at pH greater than 2 and these are the preferred stabilizers. However, silica modified with alumina are positively charged and are also suitable as a stabilizer.

Suitable promoters to drive the suspension stabilizing agent to the interface of the lubricant droplets and the aqueous phase include sulfonated polystyrenes, alginates, carboxymethyl cellulose, tetramethyl ammonium hydroxide or chloride, triethylphenyl ammonium hydroxide, triethylphenyl ammonium hydroxide, triethylphenyl ammonium chloride, diethylaminoethylmethacrylate, gelatin, glue, casein, albumin, gluten, methoxycellulose, and the like. A particularly suited promoter is a water-soluble soluble condensation product of diethanol amine and adipic acid, such as poly(adipic acid-co-methylaminoethanol), water soluble condensation products of ethylene oxide, urea, and formaldehyde and polyethyleneimine. In the case of colloidal silica as stabilizer, it is generally desired to control the pH of the system at a value of from about 2 to about 7, preferably from about 3 to 6 and most preferably 4. The promoter should be present in an amount of 1 to about 50 percent based on the amount of silica.

The dispersion of the suspension droplets containing the binder and the dispersant in the aqueous medium is then vigorously mixed by any suitable device including high speed agitation, ultrasonic devices, homogenizers, and the like in order to reduce the particle size of the lubricant droplets to less than that ultimately desired. The presence of the particulate suspension stabilizer then controls the level of coalescence that takes place until an equilibrium is reached and the particle size does not grow any farther.

The solvent is next removed from the droplets by any suitable technique, such as under reduced pressure. The solvent can also be removed by purging the stirred dispersion with air or an inert gas like nitrogen. U.S. Pat. No. 5,580,692 discloses a method by which excess water is added to the dispersion that extracts the solvent. The resulting toner particles are separated from the water/solvent mixture by filtration.

The silica stabilizer may be removed from the surface of the polymer particles if required by any suitable technique such as dissolving in HF or other fluoride ion or by adding an alkaline agent such as potassium hydroxide to the aqueous phase containing the polymer particles to thereby raise the pH to at least about 12 while stirring. The alkaline addition method is preferred. Subsequently to raising the pH and dissolving the silica, the polymer particles can be recovered by filtration and finally washed with water or other agents to remove any desired impurities from the surface thereof. The toner particles thus produced can be dried and surface treated to produce usable toner for electrophotographic engines.

The toner may optionally have charge control agents incorporated in them. The term charge-control agent refers to a toner addendum used to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; and 4,394,430; and British Patent Numbers. 1,501,065 and 1,420,839 all of which are incorporated in their entireties by reference herein. Additional charge control agents which are useful are described in U.S. Pat. Nos. 4,624,907; 4,814,250; 4,840,864; 4,834,920; 4,683,188; and 4,780,553 all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarb oxamidato(2-)], ammonium, sodium, and hydrogen (Organoiron available from Hodogaya Chemical Company Ltd.). Charge control agents are generally employed in small quantities such as, from about 0.1 to about 5 weight percent based upon the weight of the toner.

The binders useful in the practice of the present invention can be any type of polymer or resin. Preferred are polymers that are suitable as the binder for dry electrophotographic toners such as vinyl polymers, acrylic polymers, polyesters, polyurethane resins, epoxy resins, silicone resins, polyamide resins, modified rosins, and the like. Particularly preferred polymers include polyesters of aromatic or aliphatic dicarboxylic acids with one or more aliphatic diols, such as polyesters of isophthalic or terephthalic or fumaric acid with diols such as ethylene glycol, cyclohexane dimethanol and bisphenol adducts of ethylene or propylene oxides. Especially preferred is a polymer suitable for ELC, which means it is capable of being dissolved in a solvent that is immiscible with water wherein the polymer itself is substantially insoluble in water such as polyester binders Kao E and Kao N by Kao Specialties Americas LLC, a part of Kao Corporation, Japan, and styrene-butylacrylate copolymer resin binder Piccotoner 1221, from Hercules.

Preferably the acid values (expressed as milligrams of potassium hydroxide per gram of resin) of the polyester resins are in the range of 2 to 100. The polyesters may be saturated or unsaturated. Of these resins, styrene/acryl and polyester resins are particularly preferable. In the practice of this invention, it is particularly advantageous to utilize resins having a viscosity in the range of 1 to 100 centipoise when measured as a 20 weight percent solution in ethyl acetate at 25° C.

Pigments suitable for use in the practice of the present invention are disclosed, for example, in US Reissue Pat. No. 31,072 and in U.S. Pat. Nos. 4,414,152 and 4,416,965. As the colorants, known colorants can be used. The colorants include, for example, carbon black, Aniline Blue, Calcoil Blue, Chrome Yellow, Ultramarine Blue, DuPont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1 and C.I. Pigment Blue 15:3. Colorants can generally be employed in the range of from about 1 to about 90 weight percent on a total toner powder weight basis, and preferably in the range of about 2 to about 20 weight percent, and most preferably from 4 to 15 weight percent in the practice of this invention. When the colorant content is 4% or more by weight, a sufficient coloring power can be obtained, and when it is 15% or less by weight, good transparency can be obtained. Mixtures of colorants can also be used. Colorants in any form such as dry powder, its aqueous or oil dispersions, or wet cake can be used in the present invention. Colorant milled by any methods like media-mill or ball-mill can be used as well.

Any suitable organic solvent that will dissolve the polymer and which is also immiscible with water may be used in the preparation of toner particles by evaporative limited coalescence, such as for example, chloromethane, dichloromethane, ethyl acetate, propyl acetate, vinyl chloride, trichloromethane, carbon tetrachloride, ethylene chloride, trichloroethane, toluene, xylene, cyclohexanone, 2-nitropropane, and the like. Particularly useful solvents are ethyl acetate and propyl acetate for the reason that they are both good solvents for many polymers while at the same time are immiscible with water. Further, their volatility is such that they are readily removed from the discontinuous phase droplets by evaporation. Optionally, the solvent that will dissolve the binder polymer and which is immiscible with water may be a mixture of two or more water-immiscible solvents chosen from the list given above.

Toner particles can be spherical or irregular in shape. However, the shape of toner particles has a bearing on the electrostatic toner transfer and cleaning properties. Thus, for example, the transfer and cleaning efficiency of toner particles have been found to improve as the sphericity of the particles is reduced. A number of procedures to control the shape of toner particles are known in the art. In the practice of preparing toner particles by evalporative limited coalescence, additives may be employed in the water phase or in the oil phase if necessary. The additives may be added after or prior to forming the water-in-oil-in-water emulsion. In either case the interfacial tension is modified as the solvent is removed resulting in a reduction in sphericity of the particles. U.S. Pat. No. 5,283,151 describes the use of carnauba wax to achieve a reduction in sphericity of the particles. US 2008/0145779 entitled "TONER PARTICLES OF CONTROLLED SURFACE MORPHOLOGY AND METHOD OF PREPARATION" describes the use of certain metal carbamates that are useful to control sphericity and US 2008/0145780 entitled "TONER PARTICLES OF CONTROLLED MORPHOLOGY" describes the use of specific salts to control sphericity. US 2007/0298346 entitled "TONER PARTICLES OF CONTROLLED MORPHOLOGY" describes the use of quaternary ammonium tetraphenylborate salts to control sphericity. The disclosures of these patents and applications are incorporated by reference herein in their entireties.

Toner particles may also contain flow aids in the form of surface treatments. Surface treatments are typically in the form of inorganic oxides or polymeric powders with typical particle sizes of 5 nm to 1000 nm. With respect to the surface treatment agent also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 10 weight percent, and most preferably from about 0.1 to about 5 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention. One preferred spacing agent is silica, such as those commercially available from Degussa, like R-972, or from Wacker, like H2000. Other suitable spacing agents include, but are not limited to, other inorganic oxide particles, polymer particles and the like. Specific examples include, but are not limited to, titania, alumina, zirconia, and other metal oxides; and also polymer particles preferably less than 1 μm in diameter (more preferably about 0.1 μm), such as acrylic polymers, silicone-based polymers, styrenic polymers, fluoropolymers, copolymers thereof, and mixtures thereof Various other conventional additives generally present in electrophotographic toner may be included such as release agents such as waxes and lubricants. The release agents preferably used are waxes. Concretely, the releasing agents usable herein are low-molecular weight polyolefins such as polyethylene, polypropylene and polybutene; silicone resins which can be softened by heating; fatty acid amides such as oleamide, erucamide, ricinoleamide and stearamide; vegetable waxes such as carnauba wax, rice wax, candelilla wax, Japan wax and jojoba oil; animal waxes such as bees wax; mineral and petroleum waxes such as montan wax, ozocerite, ceresine, paraffin wax, microcrystalline wax and Fischer-Tropsch wax; and modified products thereof.

Irrespective of the amount of the wax inclined to be exposed on the toner particle surface, waxes having a melting point in the range of 30 to 150° C. are preferred and those having a melting point in the range of 40 to 140° C. are more preferred. The wax is, for example, 0.1 to 20% by mass, and preferably 0.5 to 9% by mass, based on the toner.

Conventional electrophotographic toners are solid particles, but use of porous particles is known. See, for instance, U.S. Pat. Nos. 4,379,825; 5,608,017; and 5,717,041; U.S. Publication No. 2005/0026064; Japanese Kokai 08-220793, US2008/0176157 and US2008/0176164, the disclosures of which are incorporated by reference herein. By porous is meant the particles have "micro", "meso" and "macro" pores which according to the International Union of Pure and Applied Chemistry are the classifications recommended for pores less than 2 nm, 2 to 50 nm, and greater than 50 nm respectively. The term porous will be used herein to include pores of all sizes, including open or closed pores. Especially preferred as toners for this invention are porous toners with porosity of between 10 and 90% and preferably between 10 and 70%.

In the course of studying the impact of pre-fusing plasticization of toner particles on fusing quality it has been discovered the unexpected result that porous toners result in a particularly synergistic effect in that they show a more pronounced improvement in fusing quality with pre fusing plasticization. Though not wishing to be bound by any specific proposed mechanism, it appears that the porous structure allows the interior of the toner to become effectively plasticized, while only surface plasticization is possible for the conventional non porous toner.

Methods for generating pores inside polymer particles are known in the field of polymer science. Porous particles can be prepared using a multiple emulsion process, in conjunction with a suspension process, particularly, the Evaporative Limited Coalescence (ELC) process, as demonstrated in US2008/0176157 and US2008/0176164. Porous toner particles are particularly advantageous in this invention because the pores can accommodate higher levels of plasticizer than the analogous non porous toner, and the rate of incorporation of volatile plasticizer, such as water, can be at a much faster rate.

A preferred process for making porous polymer particles involves basically a three-step process as described in US2008/0176157 and US2008/0176164. The first step involves the formation of a stable water-in-oil emulsion, including a first aqueous solution of a pore stabilizing hydrocolloid dispersed finely in a continuous phase of a binder polymer dissolved in an organic solvent. This first water phase creates the pores in the particles and the pore stabilizing compound controls the pore size and number of pores in the particle, while stabilizing the pores such that the final particle is not brittle or fractured easily.

Suitable pore stabilizing hydrocolloids include both naturally occurring and synthetic, water-soluble or water-swellable polymers such as, cellulose derivatives e.g., Carboxymethyl Cellulose (CMC) also referred to as sodium carboxy methyl cellulose, gelatin eg., alkali-treated gelatin such as cattle bone or hide gelatin, or acid treated gelatin such as pigskin gelatin, gelatin derivatives eg., acetylated gelatin, phthalated gelatin, and the like, substances such as proteins and protein derivatives, synthetic polymeric binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, water soluble microgels, polyelectrolytes and mixtures thereof.

In order to stabilize the initial first step water-in-oil emulsion so that it can be held without ripening or coalescence, if desired, it is preferable that the hydrocolloid in the water phase have a higher osmotic pressure than that of the binder in the oil phase depending on the solubility of water in the oil. This dramatically reduces the diffusion of water into the oil phase and thus the ripening caused by migration of water between the water droplets. One can achieve a high osmotic pressure in the water phase either by increasing the concentration of the hydrocolloid or by increasing the charge on the hydrocolloid (the counter-ions of the dissociated charges on the hydrocolloid increase the osmotic pressure of the hydrocolloid). It can be advantageous to have weak base or weak acid moieties in the pore stabilizing hydrocolloid that allow for the osmotic pressure of the hydrocolloid to be controlled by changing the pH. These hydrocolloids are referred to as "weakly dissociating hydrocolloids". For these weakly dissociating hydrocolloids the osmotic pressure can be increased by buffering the pH to favor dissociation, or by simply adding a base (or acid) to change the pH of the water phase to favor dissociation. A preferred example of such a weakly dissociating hydrocolloid is CMC that has a pH sensitive dissociation (the carboxylate is a weak acid moiety). For CMC the osmotic pressure can be increased by buffering the pH, for example using a pH 6-8 phosphate buffer, or by simply adding a base to raise the pH of the water phase to favor dissociation (for CMC the osmotic pressure increases rapidly as the pH is increased from 4-8).

Other synthetic polyelectrolyte hydrocolloids such as polystyrene sulphonate (PSS) or poly(2-acrylamido-2-methylpropanesulfonate) (PAMS) or polyphosphates are also possible hydrocolloids. These hydrocolloids have strongly dissociating moieties. While the pH control of osmotic pressure that can be advantageous, as described above, is not possible due to the strong dissociation of charges for these strongly dissociating polyelectrolyte hydrocolloids, these systems will be insensitive to varying level of acid impurities. This is a potential advantage for these strongly dissociating polyelectrolyte hydrocolloids particularly when used with binder polymers that have varying levels of acid impurities such as polyesters.

The essential properties of the pore stabilizing hydrocolloids are solubility in water, no negative impact on multiple emulsification process, and no negative impact on melt rheology of the resulting particles that is important in fusing of the particles after printing. The pore stabilizing compounds can be optionally cross-linked in the pore to minimize migration of the compound to the surface. The amount of the hydrocolloid used in the first step will depend on the amount of porosity and size of pores desired and the molecular weight of the hydrocolloid. A particularly preferred hydrocolloid is CMC and in an amount of from 0.5-20 weight percent of the binder polymer, preferably in an amount of from 1-10 weight percent of the binder polymer.

The first aqueous phase may additionally contain, if desired, salts to buffer the solution and to optionally control the osmotic pressure of the first aqueous phase as described earlier. For CMC the osmotic pressure can be increased by buffering using a pH 7 phosphate buffer. It may also contain additional porogen or pore forming agents such as ammonium carbonate.

In a preferred embodiment, useful binder polymers for preparation of toner particles by limited coalescence include those derived from vinyl monomers, such as styrene monomers, and condensation monomers such as esters and mixtures thereof. As the binder polymer, known binder resins are useable. Concretely, these binder resins include homopolymers and copolymers such as polyesters, polymers derived from styrenes, e.g. styrene and chlorostyrene; monoolefins, e.g. ethylene, propylene, butylene and isoprene; vinyl esters, e.g. vinyl acetate, vinyl propionate, vinyl benzoate and vinyl butyrate; α-methylene aliphatic monocarboxylic acid esters, e.g. methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers, e.g. vinyl methyl ether, vinyl ethyl ether and vinyl butyl ether; and vinyl ketones, e.g. vinyl methyl ketone, vinyl hexyl ketone and vinyl isopropenyl ketone. Particularly desirable binder polymers/resins include polystyrene resin, polyester resin, styrene/alkyl acrylate copolymers, styrene/alkyl methacrylate copolymers, styrene/acrylonitrile copolymer, styrene/butadiene copolymer, styrene/maleic anhydride copolymer, polyethylene resin and polypropylene resin. They further include polyurethane resin, epoxy resin, silicone resin, polyamide resin, modified rosin, paraffins and waxes. Also, especially useful are polyesters of aromatic or aliphatic dicarboxylic acids with one or more aliphatic diols, such as polyesters of isophthalic or terephthalic or fumaric acid with diols such as ethylene glycol, cyclohexane dimethanol and bisphenol adducts of ethylene or propylene oxides. Preferably the acid values (expressed as milligrams of potassium hydroxide per gram of resin) of the polyester resins are in the range of 2-100. The polyesters may be saturated or unsaturated. Of these resins, styrene/acryl and polyester resins are particularly preferable.

EXAMPLES

Toner A was a non-porous toner made by conventional polymer extrusion and pulverization techniques, made from Kao C, a polyester resin from Kao Specialties Americas LLC a part of Kao Corporation, Japan. Kao C is a fumaric acid based polyester with an acid value of 20 and a molecular weight, Mw, of 12000. This toner is typical of toners used in color electrophotographic printers. The toner is approximately 8 microns volume median particle size, containing dispersed colorant, charge control agent, and other addenda. This toner was not surface treated.

Toner B was a porous toner made from Kao E, a polyester resin from Kao Specialties Americas LLC a part of Kao Corporation, Japan. Kao E is a terephthalic acid based polyester with an acid value of 10 and a molecular weight, Mw, of 114,000. The melt Theological differences between Kao C used in the preparation of the non porous toner A and Kao E used in the preparation of the porous toner B result in a higher fusing temperature being required for the porous toner to achieve the same gloss level.

Preparation of Porous Toner: 6 Grams of carboxymethyl cellulose (CMC, MW 250K from Acros) was dissolved in 294 grams of distilled water. This was dispersed in 971 g of an organic phase containing 776.8 grams of ethyl acetate, 186.44 g of Kao E polymer resin, and 7.76 g of Pigment Blue 15:3, at 6800 RPM using a Silverson L4R homogenizer fitted with the General-Purpose Disintegrating Head. The resultant water-in-oil emulsion was further homogenized using a Microfluidizer Model #110T from Microfluidics at a pressure of 8900 psi. 1128 Grams of the resultant very fine water-in-oil emulsion, was dispersed, using the Silverson again for two minutes at 2000 RPM, in 1875 grams of the second water phase comprising a pH 4 buffer and 82.5 grams of Nalco 1060 (from Nalco) to form a water-in-oil-in-water double emulsion. This mixture was further passed through a homogenizer comprising an orifice disperser at 1 gal/min, and upon exiting the homogenization unit, the emulsion was diluted 1:1 with water followed by evaporation of the ethyl acetate at 45C under reduced pressure. The resulting suspension of beads were isolated by filtration, treated with base at pH 12.5 for 30 minutes to remove the silica on the surface, washed with water several times until the conductivity of the filtrate was below 20 uS and dried in a vacuum oven (~32° C.) for 20 hours to dry the toner beads including the water contained in the pores. The toner is approximately 7 micron volume median particle size, containing dispersed colorant, charge control agent, and other addenda. No surface treatment was applied to the toner. Porosity was 41%, determined as described below.

Method for Determining Porosity:

Instrumental Setup for Porosity Measurements of Porous/Hollow Polymer Particles by Mercury Intrusion Porosimetry Sample Preparation Approximately 0.1 grams of the powder was obtained for analysis. This sample mass is based on the combination of the porosity/interstitial voids of the sample and the available stem volume of the chosen penetrometer (sample cell). This sample was placed into a glass penetrometer bulb. After the bulb was capped, the penetrometer was placed in the porosimeter and de-gassed under rotary pump vacuum for as long as it took to reach a vacuum of 50 microns. The samples were held at this vacuum for an additional 5 minutes and then brought back to 0.5 psia for mercury filling and initial data collection at low pressure.

Instrument and Experimental

The samples are analyzed on an AutoPore IV model 9500 manufactured by Micromeritics Instrument Corporation based in Norcross, Ga. This instrument is able to prepare and run four low-pressure ports with one sample in each port. The instrument also can simultaneously run two high-pressure ports. Each of the samples was subjected to increasing hydraulic pressure on a volume of mercury in the penetrometer, which also contains the sample. As the pressure is increased on the mercury, the mercury begins to intrude or penetrate into the pores of the sample, largest pores filling first at the lowest pressures. In the case of these measurements the full pressure range of 0.55 to 60,000 psia was used to measure Hg intrusion into the pores/interstices. The reason for this is that it was desired to distinguish between the signal due to inter-particle Hg filling (interstitial voids) and intra-particle voids (internal pores). It was expected that there would be two distinct signals, the first due to the Hg filling into potentially larger interstitial voids and a second signal at higher pressure due to the Hg either penetrating into small access holes at the surface or, if closed at the surface, then eventual crushing of the hollow particles. Thus this second signal would denote the void volume or porosity of the actual particulate sample. As the pressures ramps from 0.55 psia to a maximum of 60,000 psia an accumulation of data of mercury intruded vs. pressure is collected. The pressure is transformed into equivalent cylindrical pore diameter and the total mercury volume intruded in a specific range is the total pore volume while the 50% point in that range is the median pore diameter.

All samples were analyzed with the same preparation conditions and pressure ramp table of 0.55 psia to 60,000 psia and then decreased to atmospheric again. All samples were equilibrated at each pressure point for 10 seconds both on the low and high-pressure ranges. Knowing the density of the polymer powder, the volume occupied by the mass of sample is calculated and the ratio of the void volume to the void volume+the actual sample volume yields the % porosity for the sample.

Plasticization of Toners

Samples of the toners were stored in either relatively low or high humidity chambers. The low humidity condition was created using dry Calcium Chloride, whereas high humidity was created with a saturated Copper Sulfate solution (98% RH). Samples were placed in the preconditioned environments and allowed to equilibrate.

Toner Tg and Viscosity Measurement

Figure 3A:
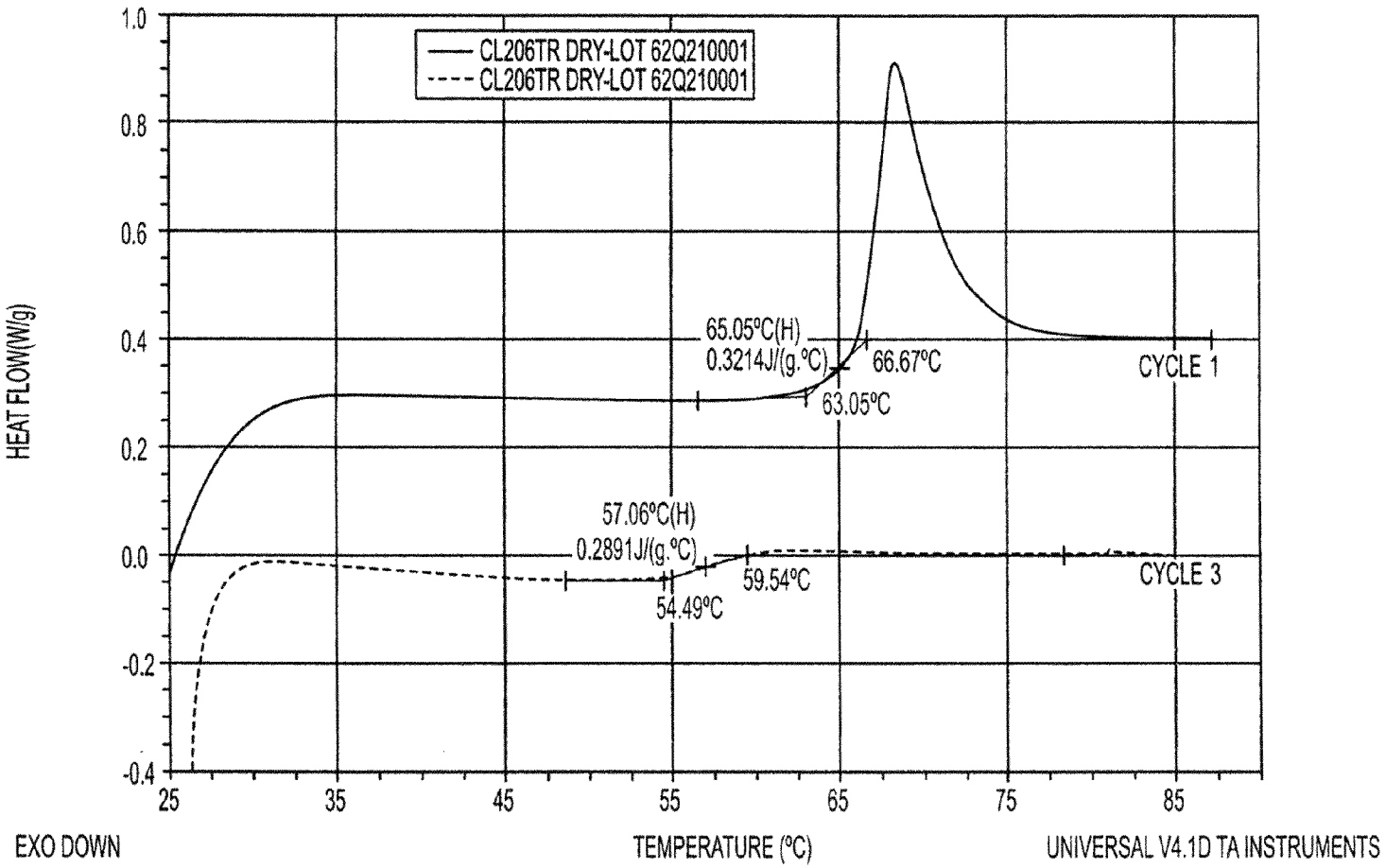
FIGS. 3*a* and 3*b* are graphs illustrating thermal analysis results for dry non-porous toner A and for humidified (i.e., plasticized) non-porous toner A of the Examples, respectively.
Figure 3B:
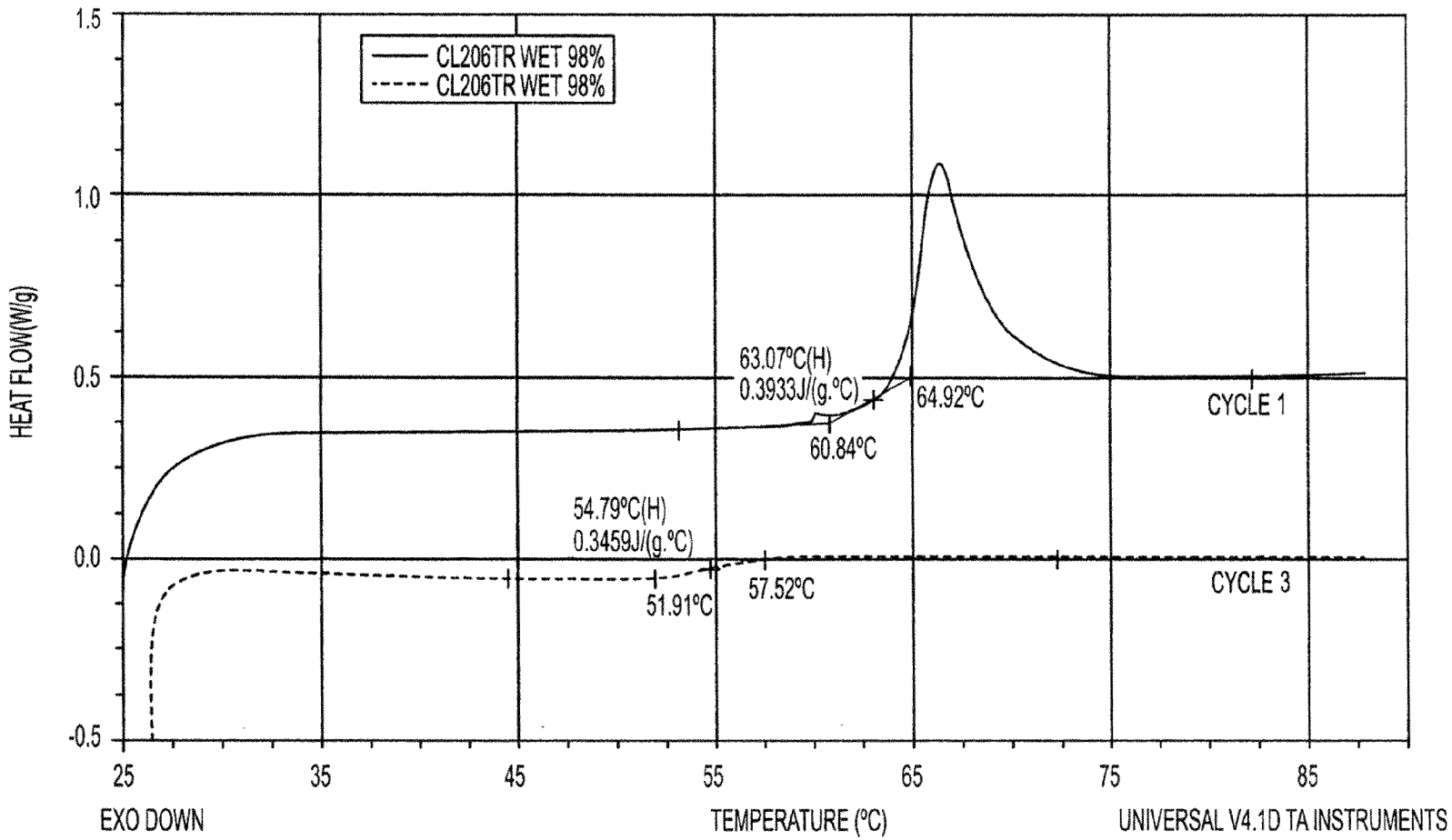

Thermal Analysis was performed on a TA Instrument Q100 Differential Scanning Calorimeter with Autosampler. The method was as follows. Samples of toner stored in either the described dry or wet (98% RH) humidity chambers and were not removed until ready to weigh and run. 10 mg of each sample was weighed and crimped into a 40 uL aluminum pan with cover using a Perkin-Elmer Universal Crimper Press. The samples were heated from 25-90 deg-C at 20 deg/min; cooled back to 25 deg-C at 20 deg/min, and heated a 2nd time to 90 deg-C at 10 deg/min. The DSC is purged with Nitrogen and cooled with an Refrigerated Cooling System. As illustrated in FIGS. 3*a* and 3*b*, respectively, the Tg for the dry non-porous toner A was determined to be 65° C., while that for humidified (i.e., plasticized) non-porous toner A was determined to be 63° C.

Toner Fusing

Toner laydowns were electrostatically deposited on Polyethylene Terphthalate support. Dry and humidified toner laydown samples were passed through the fuser assembly of an Ektaprint 250 Duplicator (trademark of Eastman Kodak Company); for each temperature a separate unfused toner image was used. The fusing conditions and lubricant release oil were as follows:

Fusing roll temperature was either 160° C. or 185° C.,
4.6 mm nip,
0.32 meters/min fusing process speed,
130-millisecond fusing nip residence time,
Amine functional PDMS release oil having an amine equivalency of 0.012 meq/gm. and viscosity 350 centistokes at 25° C.

Laydown: Toner laydowns were selected to provide an essentially continuous toner layer upon fusing. Toner A was used at an average laydown of 0.85 mg/cm2. Toner B was used at an average laydown of 0.43 mg/cm2.

TABLE 1

GLOSS RESULTS FOR FUSED TONER A (Non Porous Toner)

| | Toner Treatment | Fusing Temperature | 20 Degree Gloss |
|---|---|---|---|
| Example 1 | Non humidified | 160° C. | 10.9 |
| | Humidified | 160° C. | 17.1 |
| | | % Increase | 57% |
| | Non humidified | 185° C. | 16.5 |
| | Humidified | 185° C. | 20.6 |
| | | % Increase | 25% |

TABLE 2

GLOSS RESULTS FOR FUSED TONER B (Porous Toner)

| | Toner Treatment | Fusing Temperature | 20 Degree Gloss |
|---|---|---|---|
| Example 2 | Non Humidified | 185° C. | 3.3 |
| | Humidified | 185° C. | 6.4* |
| | | % Increase | 94% |

*average of two results

Figure 4B:
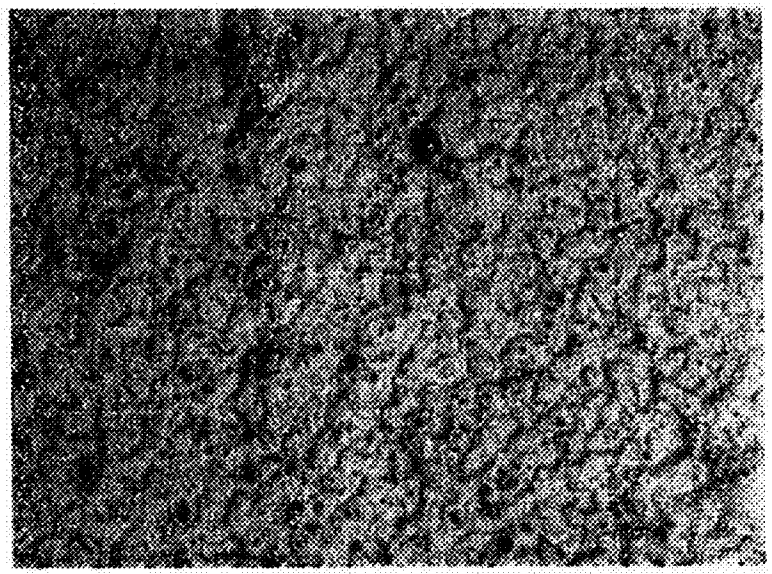
FIGS. 4*a* and 4*b* are photomicrographs of non-plasticized and pre-plasticized fused toner of the Examples, respectively.
Figure 4A:
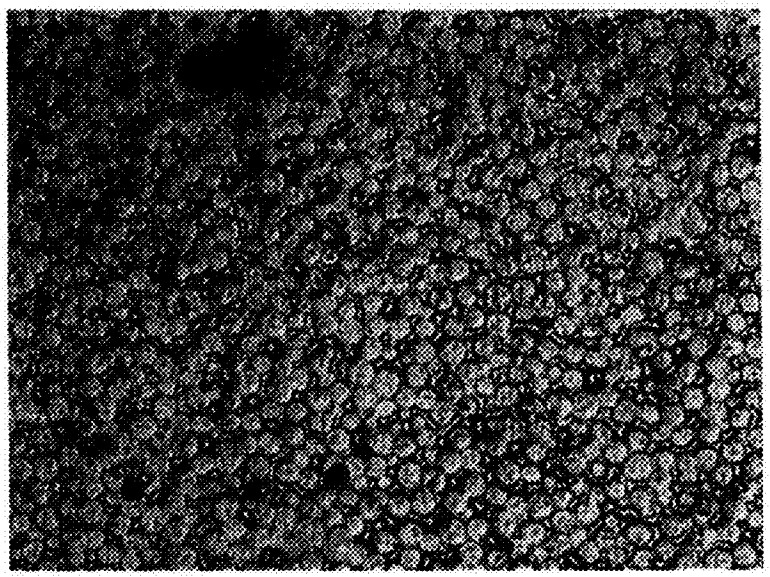

The results in Table 1 show that plasticizing conventional non porous toner with humidified air prior to fusing improves gloss, which means improved fusing. Comparing Tables 1&2 it is further clear that upon pre fusing humidification a superior fusing improvement is observed for the porous toner when compared to the non-porous toner. FIGS. 4*a* and 4*b* photomicrographs of the unpre-plasticized and pre-plasticized fused toner images of the porous toner particle examples illustrate the improved fusing performance for the plasticized porous toner particles.

The invention claimed is:

1. An electrophotographic method for producing fused toner images on a receiver medium comprising the steps of:

forming an electrostatic image pattern on an image forming member;

developing the image pattern on the image forming member with fusible toner particles thereby forming a toner image thereon; and transferring the toner image to a receiver member, and heating the toner image to form a fused toner image on the receiver medium, wherein an amount of a plasticizer is added to the toner particles of the toner image after formation of the toner image on the image forming member and prior to or concurrent with fusing of the transferred toner image on the receiver medium, and further wherein the amount of plasticizer added is effective in lowering the Tg of the toner below that of the toner under prevailing ambient conditions in the absence of the added plasticizer.

2. The method of claim 1 where the toner comprises a polyester.

3. The method of claim 1 where the plasticizer is water.

4. The method of claim 1 where the toner particles are porous.

5. The method of claim 4, wherein the toner particles have a porosity of between 10 and 90%.

6. The method of claim 1 where the Tg of the plasticized toner is at least 1° C. less than the unplasticized toner.

7. The method of claim 1 where contact fusing is used.

8. The method of claim 1 where non-contact fusing is used.

9. The method of claim 8 where the non-contact fusing method is a hot air bearing.

10. The method of claim 8 where the non-contact fusing and plasticization steps are both performed by a hot air bearing.

11. The method of claim 8 where the non-contact fusing method is flash fusing.

12. The method of claim 1 where the plasticizer is added by spraying.

13. The method of claim 1 where the method of plasticization is with an atomizer.

14. The method of claim 1 where the image is fused with a belt fuser.

15. The method of claim 1 where the toner image is first transferred from the image forming member to an intermediate transfer member, and transferred from the intermediate transfer member to the receiver member.

16. The method of claim 15, wherein the toner image is plasticized while on the intermediate transfer member.

17. The method of claim 16, wherein the plasticized toner image is transferred from the intermediate transfer member with heating of the plasticized toner directly to the receiver medium to form the fused image.

18. The method of claim 15, wherein the toner image is plasticized after transfer to the receiver member.

19. The method of claim 18, wherein the toner image is plasticized prior to fusing of the transferred toner image on the receiver medium.

20. The method of claim 18, wherein the toner image is plasticized concurrent with fusing of the transferred toner image on the receiver medium.

* * * * *